US006873465B2

(12) United States Patent
Groot

(10) Patent No.: US 6,873,465 B2
(45) Date of Patent: Mar. 29, 2005

(54) INSTALLATION FOR INCREASING THE LIGHT YIELD ON THE PLAYING SURFACE IN A STADIUM

(75) Inventor: Cornelis Groot, Den Helder (NL)

(73) Assignee: West 6 B.V. (NL)

( * ) Notice: Subject to any disclaimer, the term of this patent is extended or adjusted under 35 U.S.C. 154(b) by 0 days.

(21) Appl. No.: 10/240,916

(22) PCT Filed: Apr. 2, 2001

(86) PCT No.: PCT/NL01/00270

§ 371 (c)(1),
(2), (4) Date: Dec. 17, 2002

(87) PCT Pub. No.: WO01/74459

PCT Pub. Date: Oct. 11, 2001

(65) Prior Publication Data

US 2004/0004776 A1 Jan. 8, 2004

(30) Foreign Application Priority Data

Apr. 4, 2000 (NL) ..... 1014839

(51) Int. Cl.[7] ..... G02B 17/00; G02B 27/00; E04H 3/10; E04B 7/14

(52) U.S. Cl. ..... 359/597; 359/592; 52/6; 52/83

(58) Field of Search ..... 359/597, 592; 52/6, 83

(56) References Cited

U.S. PATENT DOCUMENTS

| | | | | | |
|---|---|---|---|---|---|
| 4,283,451 | A | * | 8/1981 | Abrahami | 428/182 |
| 4,831,792 | A | * | 5/1989 | Berger | 52/66 |
| 5,010,695 | A | * | 4/1991 | Schildge, Jr. | 52/6 |
| 5,035,093 | A | * | 7/1991 | Parazader et al. | 52/64 |
| 5,394,659 | A | * | 3/1995 | Kawaguchi et al. | 52/66 |
| 5,848,499 | A | * | 12/1998 | Schildge, Jr. | 52/66 |

FOREIGN PATENT DOCUMENTS

| | | |
|---|---|---|
| DE | 26 45 410 A | 4/1978 |
| DE | 31 03 715 A | 9/1982 |
| JP | 11-232908 | 8/1999 |

* cited by examiner

*Primary Examiner*—Judy Nguyen
*Assistant Examiner*—Magda Cruz
(74) *Attorney, Agent, or Firm*—Heller Ehrman White & McAuliffe LLP

(57) ABSTRACT

An installation for increasing the daylight yield in a stadium provided with a playing surface, stands, and optionally a covering, includes an essentially vertical light-reflecting body to guide the light incident on the body towards the playing surface in the stadium. Preferably the reflecting body is arranged along the free peripheral edge of the covering of the stadium. In one embodiment the reflecting body includes a multi-layer construction of two corrugated sheets with a light-reflecting foil between them. The installation can increase the light yield in a covered stadium by between 30% and 50%.

9 Claims, 3 Drawing Sheets

INSTALLATION FOR INCREASING THE LIGHT YIELD ON THE PLAYING SURFACE IN A STADIUM

The present invention relates to an installation for increasing the daylight yield in a stadium, which stadium is provided with a playing surface and stands. In one embodiment the stadium is provided with a covering that covers at least said stands.

The majority of stadia have a turf pitch, which is provided with stands for spectators on all sides. Stadia which are currently used for holding football matches and similar events are to an ever increasing extent of covered construction, optionally with a covering that can be opened. As a result of the covering, the spectators are able to follow the activities going on on the pitch in comfort. The covering protects them, and also those who are on the pitch, from precipitation, wind and other climatic conditions. Stadium coverings are sometimes constructed such that they can be slid open.

The height of the stands and any covering, which covering is sometimes of transparent construction and/or constructed such that it can be slid open, has the consequence that the pitch, which in general is present in the stadium, suffers because the climatic conditions are influenced both by the stands and the covering. Both in the case of a partially closed covering and in the case of a closed covering it is sometimes the case that the pitch obtains insufficient light and, moreover, the covering will have an effect on the climatic conditions in a stadium. The consequence of the abovementioned points of criticism is that the quality of the turf deteriorates and there are bare patches in the pitch, whilst in the worst case the grass or some of the grass dies and has to be replaced or renewed.

Cases are known of stadia with a covering that can be slid open where the pitch has to be completely replaced once or several times a year. The replacement of a pitch not only demands an appreciable amount of work but is also a heavy item of expenditure. The same disadvantage arises in stadia which are surrounded by high stands.

In order to solve this problem it is known to provide a stadium with a removable pitch. After the pitch has been used to hold an event, the entire pitch is transported outside the stadium, so that the grass is able to recover in the open air, under the influence of daylight, from the damage the turf has suffered during the event and is able to continue to grow under normal climatic conditions prevailing in the open air. Here it is clear that the measures that have to be taken in order to be able to transport the pitch outside are highly labour-intensive, structurally difficult to incorporate and constitute a major item of expenditure in both the design and/or construction of a stadium and during the use thereof.

The aim of the present invention is to provide an installation which ensures that the ability of the turf to recover and the life of the pitch in a stadium are increased. A further aim of the present invention is to provide a relatively inexpensive alternative for keeping the pitch in good condition for a prolonged period and obviating the need to build large-scale structures during the construction of a stadium in order to transport the pitch outside. A further aim of the present invention is to construct the installation in such a way that it can be incorporated in the stadium either during the construction phase or when the stadium is in use.

To this end, the installation according to the present invention is characterised in that it comprises an essentially vertically positioned, light-reflecting body which guides the daylight incident on the body towards the interior surface of the stadium.

The light yield can be increased by between 30% and 50% by use of the light-reflecting body according to the present invention, which is preferably arranged along the free edge of the covering over at least part thereof. As a result the growth of the grass and the ability to recover can be virtually identical to those in a stadium without a covering. Moreover, as a result of the higher light yield the temperature of the pitch will rise. Natural circulation is produced as a result, hot air rising in the centre of the roof opening, whilst cold air flows towards the turf in the opposite direction over the edge of the roof opening. This rising temperature has a beneficial effect on the growth of the grass. It is also possible to fit the light-reflecting body in the stadium itself, for example sited in the stands. This can be implemented, for example, by providing seats for the spectators with a reflective coating.

In order to prevent the spectators being blinded when the stadium is in use, it is preferable to fit protective means by means of which the light-reflecting body is covered, for example in the form of a cloth. The light-reflecting body can also be installed in the stadium such that it can be moved, so that the body can be turned out of the way.

According to one embodiment, the light-reflecting construction comprises a corrugated sheet, or some other type of material in essentially sheet form, the material surface of which is able to reflect incident light onto the turf, and the corrugated structure of which is oriented in the vertical direction.

An advantageous construction consists of two corrugated sheets which lie on top of one another and fit exactly into one another, between which a reflective foil has been arranged, preferably a silver-coloured UV-resistant metal foil, so that the foil is clamped between the two corrugated plates. At least one of the corrugated plates is of transparent construction in order to allow the light to pass unimpeded to the foil. These corrugated sheets are preferably constructed as light-weight sheets in order to restrict the weight of the construction. (Rubber) strips can be fitted on the outside edges of the corrugated sheets in order to resist the ingress of moisture.

In a stadium with a covering that can be closed, the construction is preferably installed on the inside of the edge of the roof, without protruding above it, so that closing of a sliding covering is not impeded by the light-reflecting construction. The corrugated sheets of the construction extend from the edge of the roof towards the pitch and are fitted all round the edge of the roof, so that the corrugated plates form a continuous contour.

In the case of a stadium that is provided with only one stand covering, the construction is preferably installed on the pitch side of this covering.

In the case of a stadium without a covering, the construction is preferably installed on the top of the back of the stand.

If the installation according to the invention has been installed, direct radiation of light onto the pitch remains the same as in a situation without this installation. The installation ensures that light rays which impinge on the corrugated sheets at an angle are reflected towards the pitch. The peaks and troughs of the corrugations of the corrugated sheets extend in the vertical direction over the sheet. Light that is reflected via the corrugated sheets is always directed downwards and guided towards the pitch. This can take place via one or more reflections and even via reflections via several sides. The corrugated shape of the reflecting sheets ensures a better distribution of the light over the pitch.

According to a further embodiment, the light-reflecting body consists of a reflecting material in sheet form that can be rolled or folded up, for example a reflective foil, which can be folded or rolled up while the stadium is in use for events, so that the view from the stands to the pitch is not impeded. During the period when the stadium is not in use, the material in sheet form can be unrolled or unfolded along the edge of the roof of the stadium.

Such a roll-up construction for reflective foil can easily be fitted on the edge of the roof of existing stadia. Rolling up and unrolling the reflective foil can take place either manually or motorised. In one embodiment, the installation may be moved about a hinge point.

One embodiment of an installation according to the invention will be explained in more detail with reference to the appended drawing. In the drawing.

Figure 1:
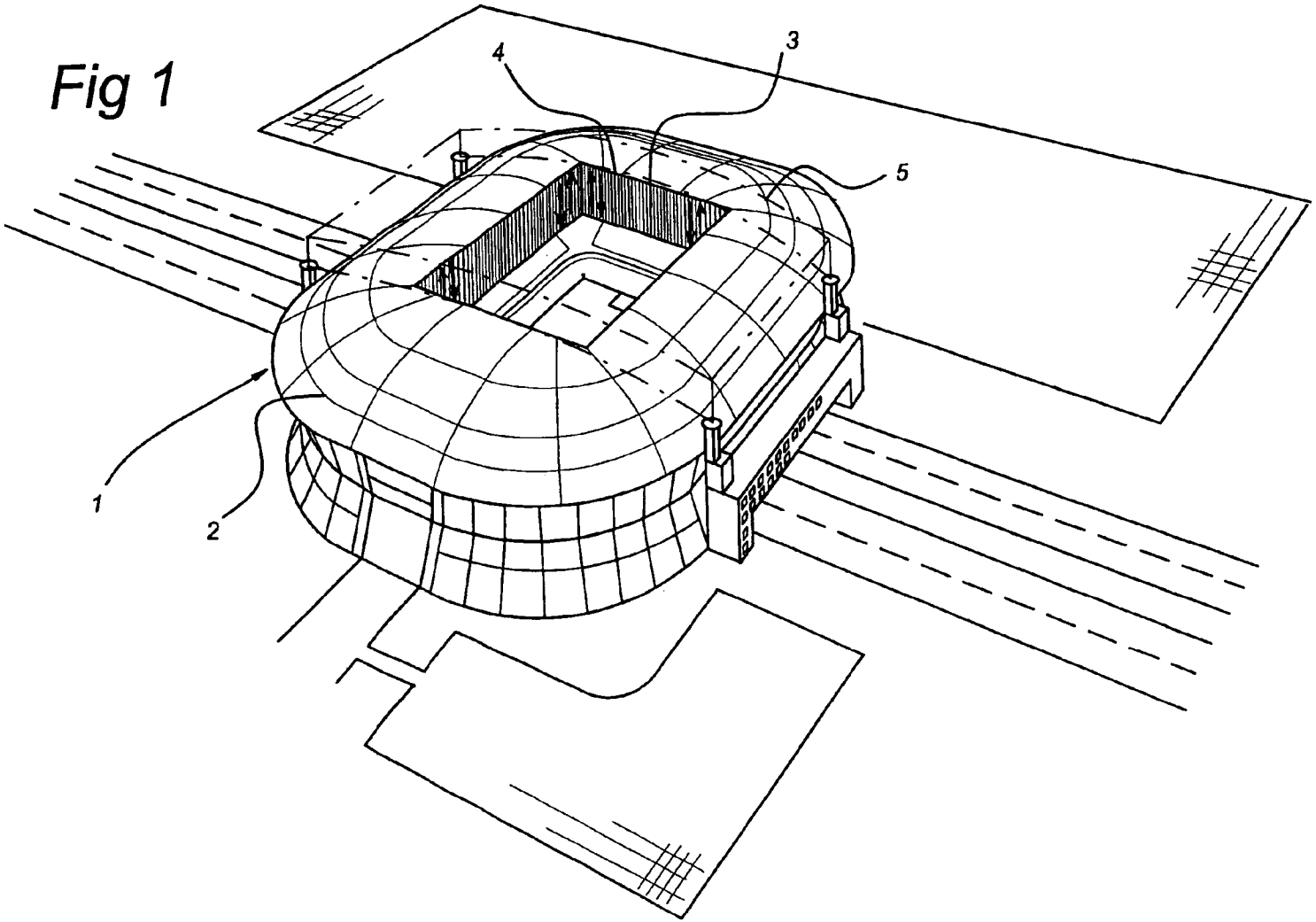
FIG. 1 shows a perspective overview of a stadium provided with a light-reflecting body according to the present invention.

FIG. 1 shows a perspective overview of the stadium 1 provided with a covering 2. Light-reflecting corrugated sheets 3 are arranged on the edge of the opening 4 in the roof of the stadium. Two curved girders 5 span the roof construction, which girders 5 support a roof that can be slid open (not shown) and that is able to cover the opening 4 in the roof. The light-reflecting corrugated sheets 3 run at the same level as or lower than the top of the roof construction so as not to impede sliding the roof construction open and shut.

Figure 2:
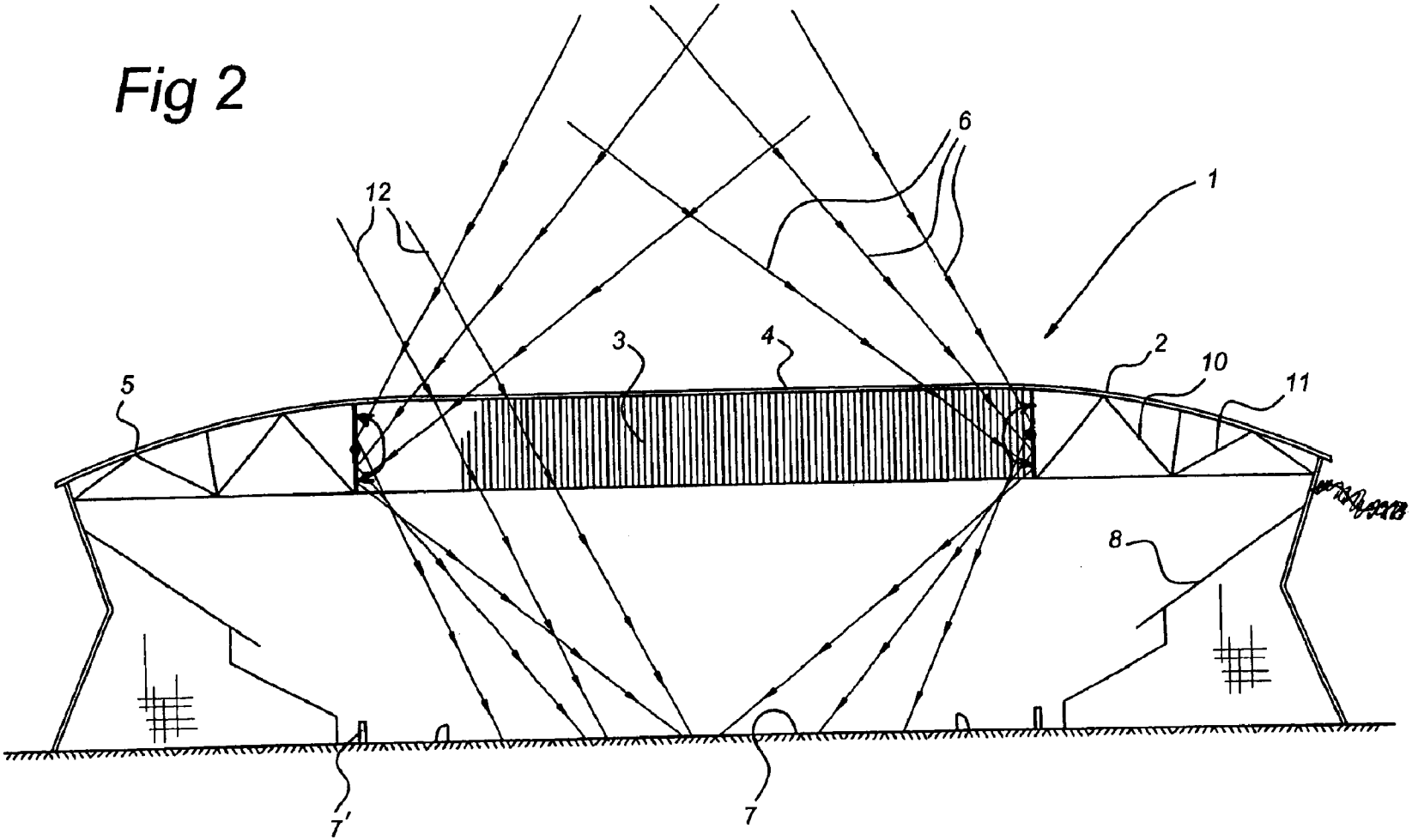
FIG. 2 shows a sectional view of the stadium in FIG. 1.

FIG. 2 shows a sectional view of the stadium in FIG. 1. The stadium 1 has stands 8 around a playing surface 7. A good view of the playing surface 7 is always possible from the stands 8. In order to prevent the spectators in the stand 8 being affected by precipitation and other weather effects, the stand 8 is provided with the covering 2. The covering 2 runs from the outside wall of the stadium towards the centre of the playing surface, as far as, approximately, above the limit 7' of the playing surface 7. The covering 2 is supported by a support construction 10. The latter consists of a number of metal tension members and compression members 11 in the form of a lattice structure.

The light-reflecting corrugated sheets 3 are fixed essentially vertically to the support structure 10 at the edge of the opening 4 in the root between the playing surface side and the sky side of the support structure 10. The light-reflecting corrugated sheets 3 do not protrude above the support structure 10 on the sky side of the support structure.

The incident daylight 6 is reflected by the light-reflecting corrugated sheets 3 towards the playing surface 7. The light yield on the playing surface 7 is increased because the incident daylight 6 that without the installation according to the present invention would not reach the playing surface 7 is reflected onto the playing surface 7 via the corrugated sheets. The directly incident daylight 12, which does not come into contact with the light-reflecting corrugated sheets, is not impeded by the reflecting corrugated sheets according to the invention and can reach the playing surface 7 unimpeded.

Figure 3:
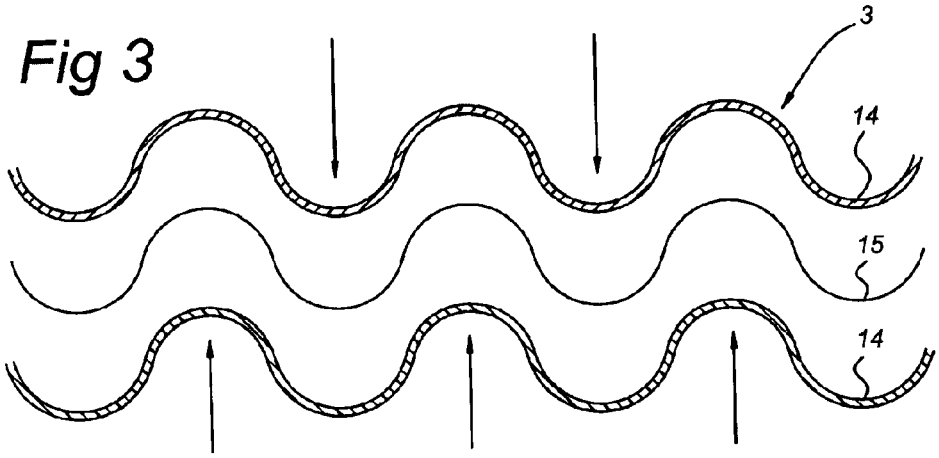
FIG. 3 shows an exposed embodiment of the light-reflecting body according to the present invention.

FIG. 3 shows an exposed section of the light-reflecting corrugated sheets 3 according to the present invention. A reflective foil 15, preferably a silver-coloured UV-resistant metal foil, is placed between two transparent corrugated sheets 14. Because the two corrugated sheets 14 are identical, a rigid, corrugated, multi-layer construction with good reflecting properties is produced on clamping the reflective foil between the two sheets.

Figure 4:
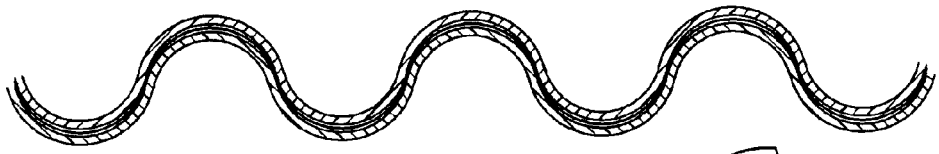
FIG. 4 shows the light-reflecting body of the embodiment shown in FIG. 3 in assembled form.

FIG. 4 shows a sectional view of the assembly of the two corrugated sheets 14 and the reflective foil 15 in a position in which they have been clamped together.

Figure 5:
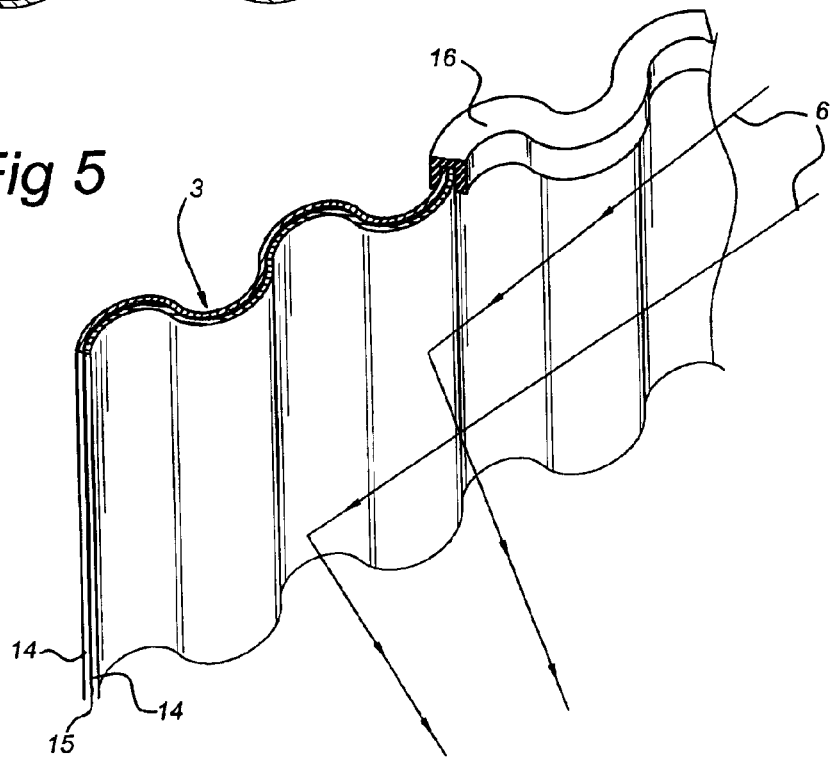
FIG. 5 shows a perspective view of the light-reflecting body according to the present invention.

FIG. 5 shows a perspective view of the assembly of two corrugated sheets 14 between which the reflective foil 15 has been clamped. At the outer edge the assembly of corrugated sheets is provided with a rubber sealing strip 16 which counteracts the penetration of water and moisture between the sheets. After all, water and moisture could have an adverse effect on the light-reflecting capacity of the installation.

Furthermore, FIG. 5 shows various light rays that are incident on the light-reflecting corrugated sheets 3 and are reflected towards the playing surface. The corrugated surface ensures that the incident light is reflected, after it has passed through the first transparent corrugated sheet 14, at various angles by the reflective foil 15 towards the playing surface 7, so that the entire surface of the playing surface 7 can be reached.

What is claimed is:

1. An installation for increasing the daylight yield in a stadium provided with a playing surface and a stand, comprising an essentially vertical light-reflecting body for guiding daylight incident on the body towards the playing surface of the stadium.

2. The installation of claim 1 where the light-reflecting body is positioned near a top of the stand.

3. The installation of claim 1 where the stadium is provided with a covering for at least the stand, and the light-reflecting body is positioned along a free edge of the covering.

4. The installation of claim 3 where the covering comprises a lattice structure having a predetermined height, and the light-reflecting body is positioned along a free edge of the covering and does not protrude above the covering.

5. The installation of claim 1 where the light-reflecting body comprises a light-reflecting foil positioned between two corrugated sheets of identical shape.

6. The installation of claim 1 where the light-reflecting body comprises a sheet of light-reflecting material.

7. The installation of claim 6 where the sheet of light-reflecting material is capable of being rolled or folded.

8. The installation of claim 1 that further comprises a shield for covering the light-reflecting body.

9. The installation of claim 1 that is capable of movement about a hinge point.

* * * * *